United States Patent [19]

Fuller

[11] 4,448,268

[45] May 15, 1984

[54] ROCK BIT WITH BEARING LUBRICANT RESERVOIR

[75] Inventor: Dennis D. Fuller, Duncanville, Tex.

[73] Assignee: Dresser Industries, Inc., Dallas, Tex.

[21] Appl. No.: 286,826

[22] Filed: Jul. 27, 1981

[51] Int. Cl.[3] ..... E21B 10/22

[52] U.S. Cl. ..... 175/228; 175/372; 308/187

[58] Field of Search ..... 175/227, 228, 371, 229, 175/372; 308/240, 8.2, DIG. 7, 217, 187, 201

[56] References Cited

U.S. PATENT DOCUMENTS

| | | | |
|---|---|---|---|
| 3,027,626 | 4/1962 | Murphy | 308/187 |
| 3,096,129 | 7/1963 | Hay | 308/187 |
| 3,630,584 | 12/1971 | McKee | 308/187 |
| 3,784,264 | 1/1974 | Jackson | 175/227 X |
| 4,103,759 | 8/1978 | Erich et al. | 308/187 X |
| 4,207,658 | 6/1980 | Sorenson | 308/8.2 X |
| 4,284,151 | 8/1981 | Levefelt | 175/227 |
| 4,286,829 | 9/1981 | Heemskerk | 308/187 |

OTHER PUBLICATIONS

Jamison, Warren E., "Applications of Microporous Polymer Lubricants", *Lubrication Engineering*, Dec. 1982, pp. 758–761.

*Primary Examiner*—James A. Leppink
*Assistant Examiner*—Michael Starinsky
*Attorney, Agent, or Firm*—Fred A. Winans

[57] ABSTRACT

A rotary rock bit having the load bearing elements between the axle and the cone cutter encased in a permeable porous plastic material having lubricant in the pores thereof, with the material substantially filling a portion of the bearing cavity to seal the cavity and a lubricant reservoir in the bit with a lubricant flow passage therefrom to adjacent said material to replenish the lubricant lost from the pores during use.

5 Claims, 5 Drawing Figures

FIG. 1
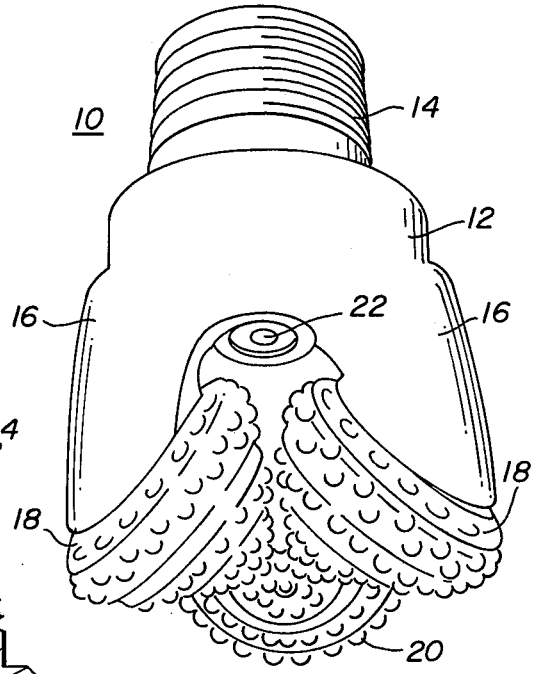
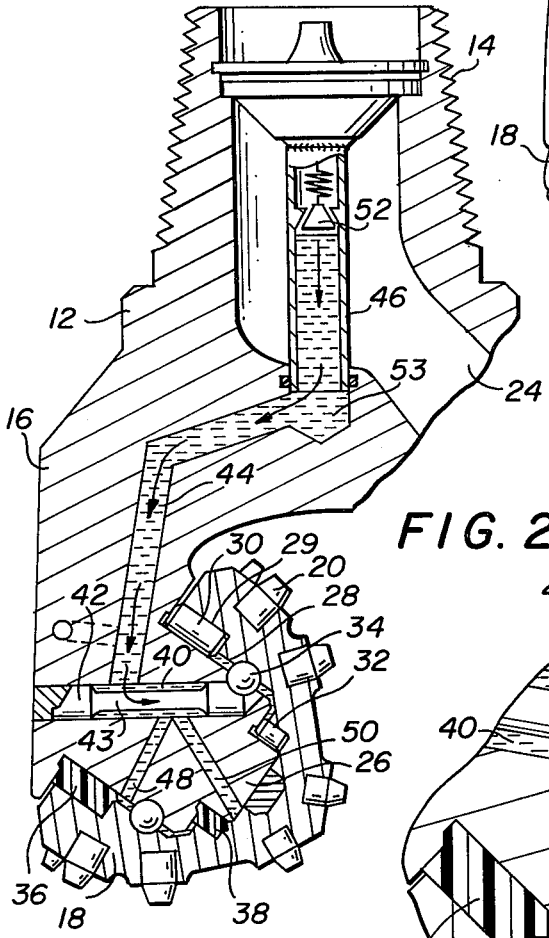
FIG. 2
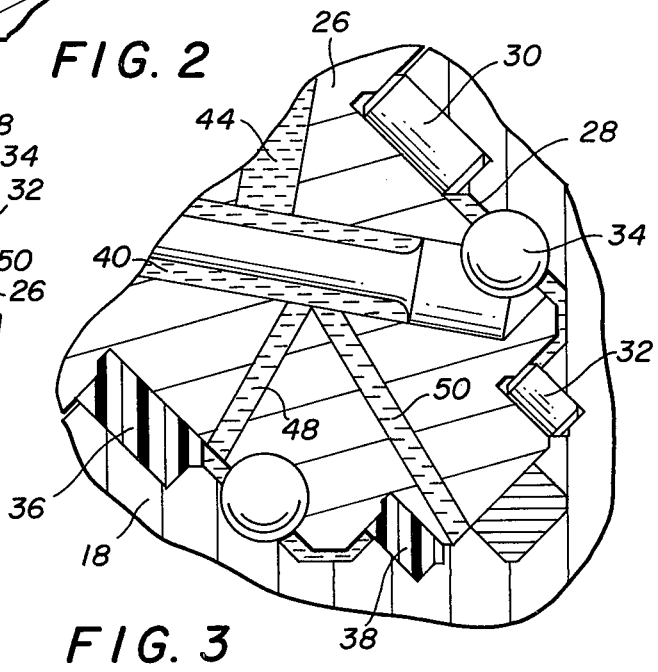
FIG. 3

ROCK BIT WITH BEARING LUBRICANT RESERVOIR

FIELD OF THE INVENTION

This invention relates to a rotary earth boring bit and, more particularly, to a bit having rolling bearing elements caged in a semi-solid permeable porous plastic having lubricant in the pores as described and claimed in co-pending, commonly owned U.S. Pat. No. 4,280,571 filed Jan. 24, 1980.

BACKGROUND OF THE INVENTION

In the above two disclosures a rotary rock bit is described having rolling bearing elements housed between facing opposed annular races on the axle portion of the bit body and the rotary cutter journaled thereon. The bearing elements are caged in a semi-solid permeable porous plastic bracelet having lubricant in the pores that provides in situ lubrication to the bearing elements during use and at least initially provides an annular seal for the bearing cavity to prevent the ingress of external debris into the cavity.

However, in that the material was exposed to a pressurized bearing conditioning fluid (such as pressurized air) the combined effects of the loading action on the material, the loss in volume as the lubricant was depleted therefrom, and the abrasive action of the external debris ultimately resulted in the gradual extrusion of the material from the bearing cavity, resulting in the bearing cavity ultimately becoming open to the flow of the bearing conditioning fluid therethrough to cool and lubicate the bearing and prevent debris from entering the cavity.

Although the above structure considerably extended the effective bearing life of such a bit, it still had a finite life that resulted quite often in bearing failure prior to the cutting structure becoming dull. Also, it is known in the prior art, and particularly common in rotary bits for drilling oil and gas wells wherein the circulating fluid is a "mud", to have a lubricant reservoir providing lubricant communication to the bearings and having an annular elastomeric seal at the mouth of the cone cutter bore to seal the bearing cavity from external material and seal the lubricant in. However, because of seal fatigue failure due to the pumping pulsating mechanical forces transferred to the seal from the relative motion between the arm journal and cone cutter, the seal is a life limiting factor and the seal effectiveness has occasionally been quite short resulting in premature bearing failure from loss of lubricant and ingress of debris.

SUMMARY OF THE INVENTION

This invention provides a rotary rock bit of the above type having rolling bearing elements housed in a cavity between an axle and the cutting member journaled thereon with the bearing elements caged in intimate contact in a permeable porous plastic material having lubricant within the pores for in situ lubrication of the bearing elements as the bit operates. A lubricant reservoir in the bit body is in lubricant flow communication with the material to supply lubricant to adjacent the material for replenishing through a wicking or capillary action, lubricant lost from the material. Replenishing the lubricant substantially diminishes the shrinkage of the material and retards its extrusion from the cavity to lengthen the period of oil lubrication and extend further the life of the bearing.

In addition, replenishing the oil to the material from the reservoir permits the plastic/oil material to be composed of less oil and more structural plastic initially so that the material can have greater initial strength which is eroded less by the external debris that contacts it and which is better able to withstand the fatigue and shear stresses it encounters without breaking up, thereby decreasing the loss of the material from the cavity and further extending the period of oil lubricated bearing life.

In addition, with the use of such permeable porous plastic material caging and lubricating the bearings, an annular elastomeric seal can be employed adjacent the mouth of the opening in the cone cutter. This is because the seal is not exposed to the internal hydrodynamic forces of local pressure build-up from the relative motion between the cone cutter and the axle in that the lubricant is generally metered to the plastic material by capillary draw and the seal does not see any local "pools" of non-compressible liquid that contribute to seal fatigue. Although the seal is still subjected to failure from attack by external abrasive material, elimination of internal stresses prolongs its life. With the elastomeric seal life thus prolonged, the plastic material itself is shielded from attack from external debris over an extended period further increasing the length of its presence in the cavity and thus the life of the bearing.

DESCRIPTION OF THE DRAWINGS

FIG. 1 is a pictorial view of a tri-cone rotary rock bit;

FIG. 2 is an elevational cross-sectional view generally along the axis and one arm of the bit of FIG. 1 and showing a lubricant reservoir and distribution passages supplying lubricant to plastic encapsulated bearings according to the present invention;

FIG. 3 is an enlarged view of a portion of FIG. 2;

DESCRIPTION OF THE PREFERRED EMBODIMENT

Figure 4:
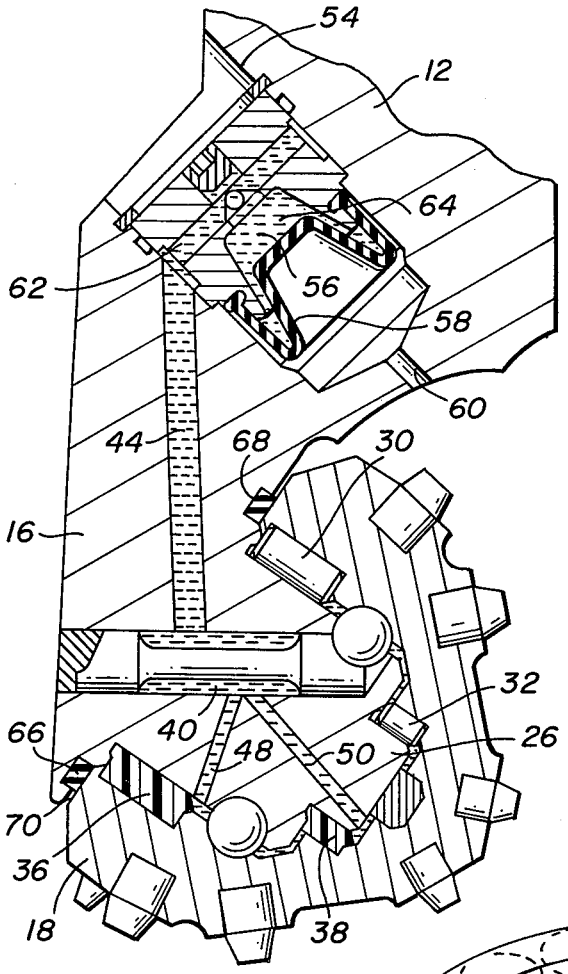
FIG. 4 is a view similar to FIG. 2 showing an internal sealed lubricating system embodying the invention; and, FIG. 5 is a schematic view illustrating the lubricant distribution from a reservoir to a face of the porous plastic material encasing the bearing elements according to the invention.

Reference is made to FIG. 1 which shows a typical tri-cone rotary rock bit 10 having a body portion 12 defining an upper threaded pin 14 for threaded attachment to drill pipe (not shown) and three depending arms 16 (only two shown). Each arm supports a rotatable cone cutter 18 having annular rows of cutting elements or inserts 20 distributed about the surface. A fluid outlet nozzle 22 is housed in the body between adjacent arms to direct fluid from the hollow interior of the body to the borehole to flush the cutting debris from the hole. In the case of blast hole bits such fluid is primarily pressurized air and in the case of oil or gas well bits, such fluid is a mixture of water and chemicals referred to as "mud". It is to be understood that with either fluid, the external downhole conditions are extremely abrasive.

Referring now to FIGS. 2 and 3, the body and one arm of a typical blast hole bit is shown which defines a pressurized air passage 24 for delivering air through the nozzle to the borehole to fluidize the cuttings. As therein seen, the arm 16 terminates in a downwardly inwardly extending axle portion 26. The cone cutter 18 has an internal cavity 28 configured to be received on the axle portion in annular spaced relation to define in the space therebetween a plurality of cooperating inner and outer races for separate annular arrays of rolling bearing members. Thus, as is seen, a plurality of roller bearings 30 are retained between races adjacent the mouth 29 to the cone cavity; another annular array of roller bearings 32 are retained between races adjacent the distal end of the axle portion; and, an annular array of ball bearings 34 is retained between races generally mid-way therebetween.

The roller bearing elements 30, 32 are respectively caged in and in intimate contact with a semi-solid permeable porous plastic material having lubricant dispersed throughout the pores thereof for in situ lubrication of the bearings and races such as the material disclosed and claimed in U.S. Pat. Nos. 3,541,011 issued Nov. 17, 1970 and 3,547,819 issued Dec. 15, 1970.

As in the previously identified commonly-owned co-pending patent and application, the material forms an annular cage 36, 38 for the respective bearing elements, which in cooperation with the bearing elements substantially fills the annular space between the cone cavity 29 and axle portion 26 over the axial extent of the respective races. Further, for purposes of assembly, each bearing array and cage of plastic material can be provided by injecting the plastic material into the bearing cavity once the bearings are placed therein or they are pre-formed, as molded, together to form a bracelet of bearings and material which is either inserted in the cone cavity or disposed over the axle portion prior to the cone cutter being assembled on the axle.

In this regard, a passage 40 is provided from the external side of the arm 16 through the axle portion to exit at the appropriate races between the cone cutter 18 and axle portion 26 for inserting the ball bearing members in this space after the cone is mounted on the axle. A plug member 42 having a necked down portion 43 is inserted and welded to retain the ball bearing members in place which in turn retains the cutter on the axle portion.

Passage 40 is in fluid flow communication with a passage 44 extending upwardly through the arm 16. A standpipe 46 is sealingly retained within the passage 24 and in direct flow communication with the passage 44. In previous blast hole bit construction such as disclosed in U.S. Pat. No. 4,154,313, of common assignee to the instant invention, such structure provided an air flow path for delivering pressurized air to the bearing cavity between the cutter and the axle portion as through distributing air passages 48, 50 in the axle portion, which then exited the cone cavity to keep the bearings cool and debris from entering the bearing cavity.

However, according to the present invention, the standpipe 46, passages 40, 48 and 50 are filled with a lubricant 53 such as an axle grease providing a lubricant reservoir.

It will be noted that the distributing passages 48, 50 herein terminate adjacent the innermost axial face of the roller bearing and porous plastic cage assemblies 30–36 and 32–38 respectively.

It will also be noted that the upper portion of the standpipe 46 contains a check valve 52 biased to a closed position to keep the grease from flowing out if the bit 10 should become inverted, however, opened under the influence of air pressure to place pressure on the grease in the passages.

Thus, with the bearing 30 and porous plastic cage assembly 36 generally sealing the cone cavity at the mouth 29, flow of lubricant from the reservoir is prevented, however, as the lubricant within the plastic material is dispersed thereoutof during use because of the various loads and stresses placed on the cage material, the presence of adjacent lubricant under pressure to one face of the cage causes the lubricant from the reservoir to be absorbed as through capillary draw into the plastic material to replenish the lost lubricant and extend the life of the porous plastic cage material.

Reference is now made to FIG. 4 which illustrates generally the same concept of providing a rock bit with a lubricant reservoir with lubricant distributing passages to adjacent an axial upstream face of a bearing and permeable porous plastic cage assembly; however, in this instance the lubricant reservoir is sealed and the bit has an elastomeric annular seal to assist in preventing ingress of external abrasive material into the bearing cavity.

With like structure being identified with common reference numbers it is seen that the bit body 12 has a bore 54 therethrough which contains a sealed lubricant reservoir 56 therein similar to the reservoir described in commonly-owned U.S. Pat. No. 4,274,498. The reservoir is closed at one end by a flexible diaphragm 58 open to the downhole fluid pressure through opening 60 and is filled with a lubricant 64. The outler 62 of the reservoir 56 is in fluid flow communication with passage 44 which again is in communication with distributing passages 48 and 50 through passage 40. It is also to be understood that a single centralized reservoir could likewise supply pressurized lubricant to the bearing cavities for all cutters.)

An annular elastomeric seal ring 66 encircles the axle portion 26, as retained in a groove 68 therein, for sealingly engaging the facing peripheral shoulder 70 adjacent the cone cavity. Thus, although the porous plastic cage and bearing assembly 30–36 substantially fills and seals the bearing cavity adjacent the mouth 29 the second seal 66 protects the cage material from immediate exposure to the abrasive external matter and thereby prolongs its useful life.

The sealed lubricant reservoir 56 permits a less viscous lubricating material to fill the reservoir without concern for loss during handling and thus a lubricant such as the original lubricant used in forming the cage material can be used in this configuration. Such lubricant is more apt to be easily absorbed into the pores as the original lubricant is depleted therefrom.

Further, although the sealed lubricant reservoir 56 of FIG. 4 is shown in conjunction with the elastomer seal ring 66, it is to be understood that the seal ring is not necessary to the essence of the invention; and, alternatively the open reservoir 46 of FIG. 1 could be associated with a bit having an annular seal ring such as 70 at the mouth 29 of the cavity.

In both instances, it is emphasized that the presence of the porous, permeable plastic cage and bearing assemblies 30–36 fill and seal the mouth 29 of the bearing cavity and in conjunction with the cage and bearing assembly 32–38 provide lubricant to the bearings without trapping pockets of lubricant that, due to wobble of the bit on the axle portion during use tend to introduce hydrodynamic stresses to the annular seal 66. Thus, the stresses on such seal are reduced by plastic cage material providing a lubricant and a seal against the accumulation of internal lubricant "pools" adjacent the annular seal 66.

Figure 5:
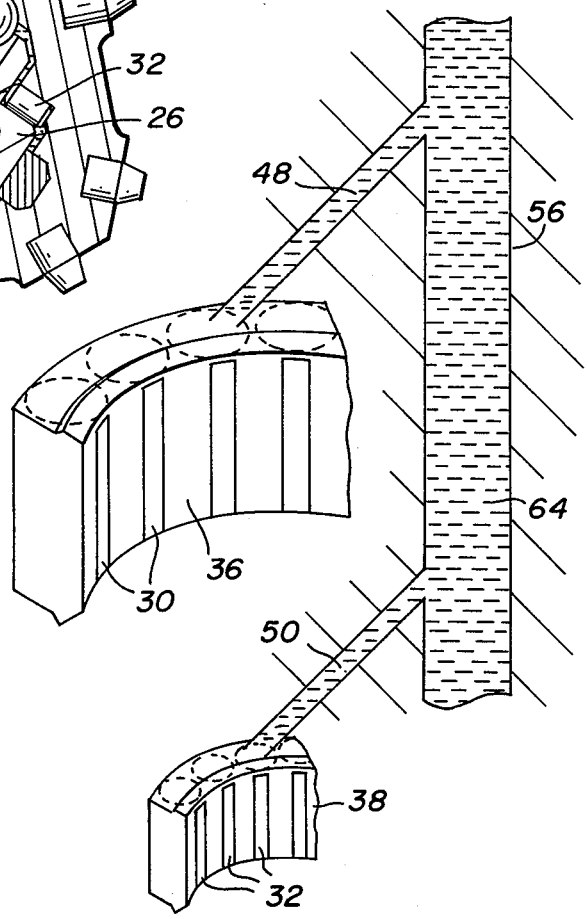

Referring now to FIG. 5, a schematic view is shown illustrating the delivery or distribution of a lubricant 64 from a pressurized reservoir 56 to an axial face of the bearing and cage assemblies 30–36 and 32–38 for wicking into the permeable porous plastic cage material to replenish the lubricant lost from the pores thereof so that the material maintains its initial sealing volume and ability to lubricate the caged bearings and adjacent races without being prematurely extruded from the bearing cavity by the pressure acting on the lubricant, thereby extending the length of lubrication without loss of the effective seal against the ingress of external matter. This in turn extends the effective life of the bearing of the rock bit.

I claim:

1. A rotary rock bit comprising:

a bit body defining a pressurized fluid flow path therethrough and having at least one arm terminating at its free end in an axle portion;

a rotatable cutter member having an internal open cavity for receipt therein of said axle portion in radial spaced relation to define an annular bearing cavity;

annular bearing and cage assembly means disposed in said annular cavity and comprising:

at least one annular array of rolling load bearing elements, with all bearing elements thereof retained in said annular array by being caged in and in intimate contact with a permeable porous plastic material having a flowable lubricant in the pores thereof and providing a lubricating cage for said rolling bearing elements, said at least one annular array of rolling bearing elements and plastic material substantially filling the annular bearing cavity adjacent the initial portion of said open cutter cavity; and a lubricant reservoir in said body and lubricant passages therefrom to said bearing cavity terminating adjacent said cage, lubricant in said reservoir and passages and means for pressurizing said lubricant to force lubricant to flow from said reservoir to adjacent said permeable porous plastic material to replenish through capillary draw thereinto the lubricant lost from said pores of said material during use.

2. A rotary rock bit according to claim 1 wherein sid reservoir is generally open to said pressurized fluid flow path.

3. A rotary rock bit according to claim 1 wherein said reservoir is closed by a flexible diaphragm member having one face open to said pressurized fluid for transmitting the pressure of said fluid to said lubricant in said reservoir.

4. Structure according to claim 2 or 3 wherein said annular bearing and cage assembly means further comprises at least a second annular array of rolling load bearing elements caged in, and in intimate contact with, a permeable, porous plastic material having lubricant in the pores and wherein said lubricant passages include a first passage terminating adjacent said one annular array of rolling bearing elements and said second passage terminating adjacent said second annular array of rolling bearing elements.

5. Structure according to claim 2 or 3 having an elastomeric annular seal ring for sealing engagement between said rotatable cutters and said arm to seal said bearing cavity downstream of said one annular array of load bearing elements encased in said plastic material to protect said material from external abrasive matter.

* * * * *